US005649434A

United States Patent [19]

Itzkowitz

[11] Patent Number: 5,649,434

[45] Date of Patent: Jul. 22, 1997

[54] INVISIBLE SETTING FOR ROUND DIAMONDS

[75] Inventor: Israel Itzkowitz, North Hollywood, Calif.

[73] Assignee: Ambar Diamonds Inc., Los Angeles, Calif.

[21] Appl. No.: 588,439

[22] Filed: Jan. 18, 1996

[51] Int. Cl.[6] ..... A44C 17/02

[52] U.S. Cl. ..... 63/26; 63/32

[58] Field of Search ..... 63/26, 27, 32, 63/28; D11/89, 90, 91, 92

[56] References Cited

U.S. PATENT DOCUMENTS

| | | | |
|---|---|---|---|
| 3,665,729 | 5/1972 | Elbe | D11/89 X |
| 4,118,949 | 10/1978 | Grossbard | 63/32 |
| 5,115,649 | 5/1992 | Amber | 63/32 X |
| 5,123,265 | 6/1992 | Ramot | 63/32 X |
| 5,437,167 | 8/1995 | Amber | 63/32 X |

*Primary Examiner*—Kien T. Nguyen
*Attorney, Agent, or Firm*—Howard C. Miskin

[57] ABSTRACT

A round diamond having a girdle with oppositely located flattened portions is disclosed. Each of the flattened portions has a cut-out with sloped walls. The girdle preferably has facets at its circumference, except at its flattened portion. The round diamond is set into a barrel having a ridge member comprising a prong dimension to fit into the respective cut-out and to frictionally engage one of the sloped walls of the cut-out, thereby, rigidly securing the diamond to the barrel.

5 Claims, 6 Drawing Sheets

INVISIBLE SETTING FOR ROUND DIAMONDS

BACKGROUND OF THE INVENTION

This invention relates to a method and apparatus for setting diamonds or precious stones and, more particularly, for setting a diamond in a mount so that the setting is invisible when one views the diamond and, thus, so that the setting does not detract from the luster of the diamond.

Diamonds emanate a luster that is extremely appealing to a human eye. It is extremely desired that a diamond be set onto a mount, in such a manner that the mount or setting is invisible to the viewer's eye, thereby, inhibiting the mount from detracting from the luster of the diamond that is a measure of the apparent, if not actual, value of the diamond itself. The luster is one of the paramount characteristics of the esthetic appeal of the diamond. The mountings of diamonds so that the mount is invisible are well known in the art and are described, for example, in U.S. Pat. Nos. 5,072,601 ('601) and 5,115,649 ('649), both of which are herein incorporated by reference. The '601 patent discloses square-shaped diamond settings, whereas the '649 patent discloses round diamond settings. The '649 patent further discloses a round diamond having sloped grooves into which is inserted and then rotated complementary walls of a holder to interlock therebetween and form an article of jewelry. The '601 and '649 patents both serve well their intended purpose, but it is further desired that mounting means be provided that are particularly suited for round diamonds and which not only provide for invisible settings for the round diamonds, but also allow the round diamonds to be more easily set into their associated holder without any rotation therebetween, yet rigidly attached thereto.

Accordingly, it is a principal object of the present invention to provide a method and apparatus for invisibly setting round diamonds so as to enhance the overall esthetic appeal of the diamonds being worn by respective owners, and yet allow the round diamonds to be more easily affixed within their mounting, for example, in a snap-lock manner.

It is another object of the present invention to provide a method and apparatus for invisibly setting round diamonds in which the set diamond is securely held and is unlikely to be accidentally dislodged so as to fall out from the setting thereof.

Further still, it is an object of the present invention to provide a method and apparatus for invisible settings of round diamonds that are held in a mount selected of a material that assists in the securing of the diamond within the mounts.

Other objects, advantages and features of the invention will become more apparent from the following description.

SUMMARY OF THE INVENTION

The present invention is directed to a setting for a round diamond that is substantially invisible to the observer's eye, and yet allows for the diamond to be easily and rigidly secured therein.

The article of jewelry incorporating the invisible setting of the present invention comprises a round diamond, and a barrel having means for serving as a mount for securely holding the round diamond. The round diamond has a table, a girdle and a pavilion located below the girdle. The girdle has first and second oppositely disposed flattened portions spaced apart by a first predetermined distance and each having a cut-out with a defined width and comprising at least two walls one of which is directed inward and downward into the diamond and the other which is directed inward and upward into the diamond. The at least two walls merge to form a groove that extends across the width of the cut-out. At least one of the two walls have an entrance portion with an upwardly directed portion having a first defined angle relative to the surface of the face. The pavilion preferably has facets comprising sloped walls having a second defined angle relative to the table and different from the first defined angle. The barrel has a bore with a diameter which is less than the first predetermined diameter of the girdle and has an inner wall with a ridge means having a prong and sides oppositely disposed from each other to correspond to the flattened portions. The prong is dimensioned to snugly fit into the cut-outs and engage at least a portion of one of the sloped walls of the cut-out. The invisible setting is achieved because the barrel having the ridge means is set beneath the diamond, thereby, rendering the setting invisible while the diamond is being observed by a normal viewer. The girdle preferably has facets around its perimeter except for the flattened portion thereof.

DETAILED DESCRIPTION OF THE PREFERRED EMBODIMENT

Figure 1:
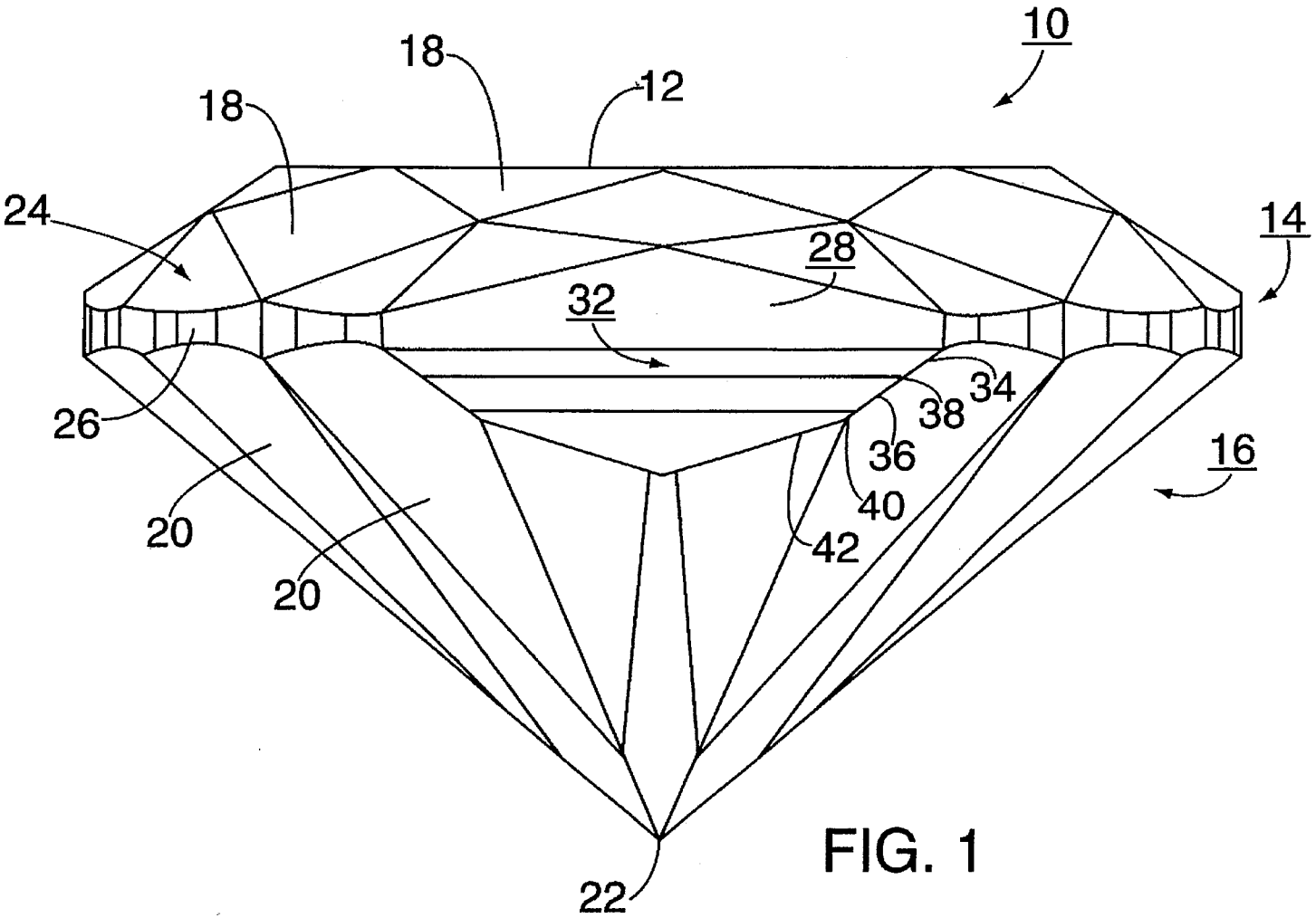
FIG. 1 is a side view of the round diamond of the present invention.

Referring to the drawings, wherein the same reference numbers indicate the same elements throughout, there is shown in FIG. 1 a side view of the round diamond 10 or some other precious stone of the present invention. The round diamond is selected so that its parameters accommodate its mounting or setting into a carrier or mount, commonly referred to as a barrel. The parameters of the diamond are also selected so that the setting is made invisible by the diamond, thereby, holding and yet preventing the setting from distracting from the luster emanating from the round diamond 10. The round diamond 10 has a table 12, a girdle 14, and a pavilion 16 located below the girdle 14.

The table 12 and the girdle 14 are separated from each other by a plurality of facets 18. The pavilion 16 has a plurality of facets 20 that extend upward (as viewed in FIG. 1) from their origin or tip 22 to the girdle 14. The girdle 14 has a belt 24 that carries a plurality of facets 26. The facets 26 extend all around the periphery of the girdle 14, except for flattened portion 28 and for flattened portion 30 (not shown in FIG. 1 but shown in FIG. 2). Each of the flattened portions 28 (see FIG. 1) and 30 has a cut-out 32 which comprises two sloped walls 34 and 36 having predetermined dimensions. As further seen in FIG. 1, each of the sloped walls 34 and 36 runs substantially parallel to the top surface of the table 12. As will be further described with reference to FIG. 6, the sloped wall 34 is directed inward and downward into the round diamond 10, whereas the sloped wall 36 is directed inward and upward into round diamond 10. The sloped walls 34 and 36 merge to form a groove 38 that preferably extends across the width of the cut-out 36. The outer edge of the sloped wall 36 defines a boundary 40 which abuts up against a prism 42 of pavilion 16. The flattened portions 28 and 30 may be further described with reference to FIG. 2.

Figure 2:
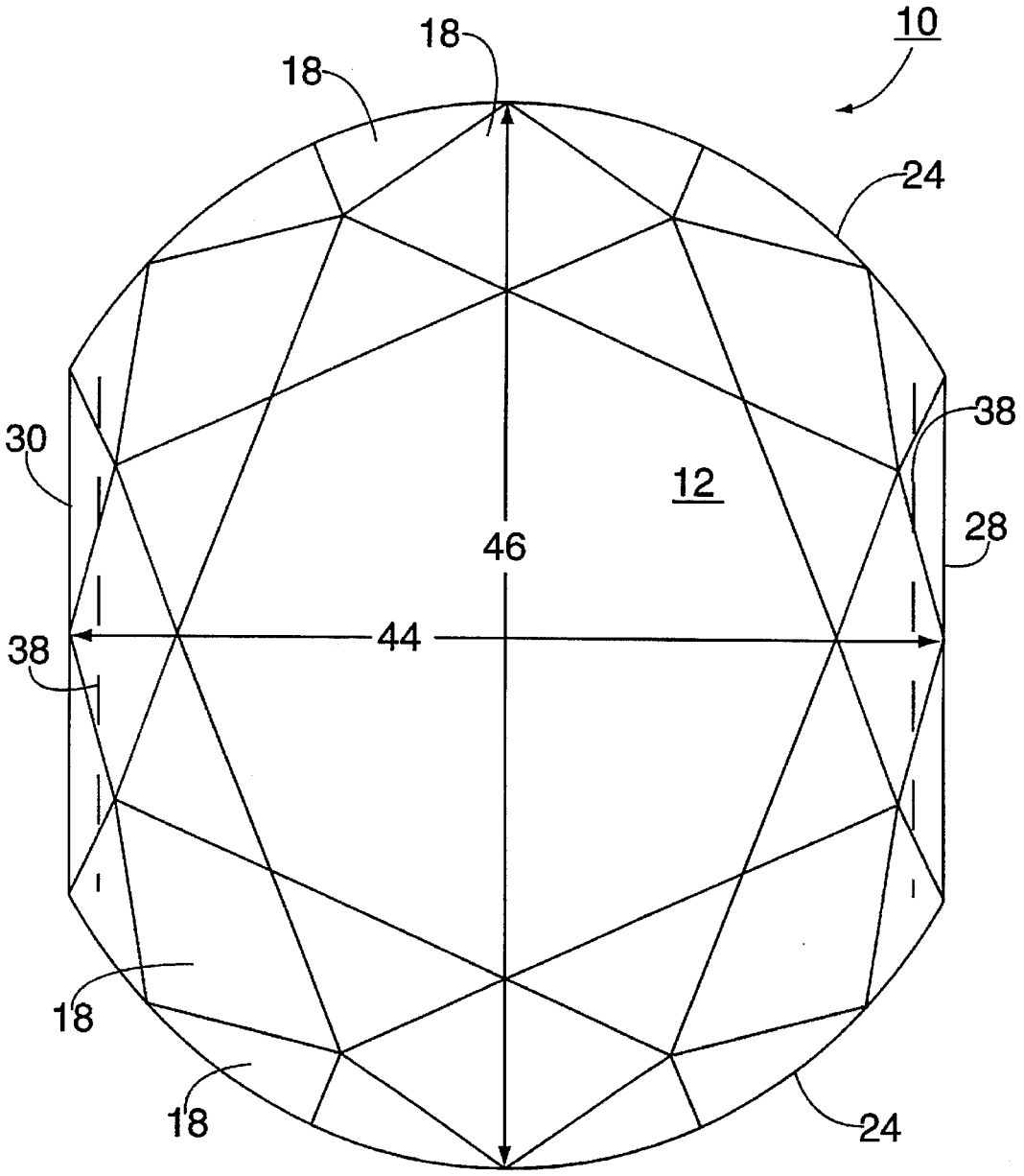
FIG. 2 is a top view of the diamond of the present invention.

As seen in FIG. 2, which is a top view of the round diamond 10, the flattened portions 28 and 30 are devoid of the faceted belt 24. Further, the flattened portions 28 and 30 are disposed from each other on opposite sides of the round diamond 10, and are separated from each other by a first predetermined distance 44. Furthermore, as indicated in FIG. 2, the round diamond 10 has a predetermined diameter 46. Further details of the round diamond 10, in particular its pavilion 16, may be further described with reference to FIG. 3.

Figure 3:
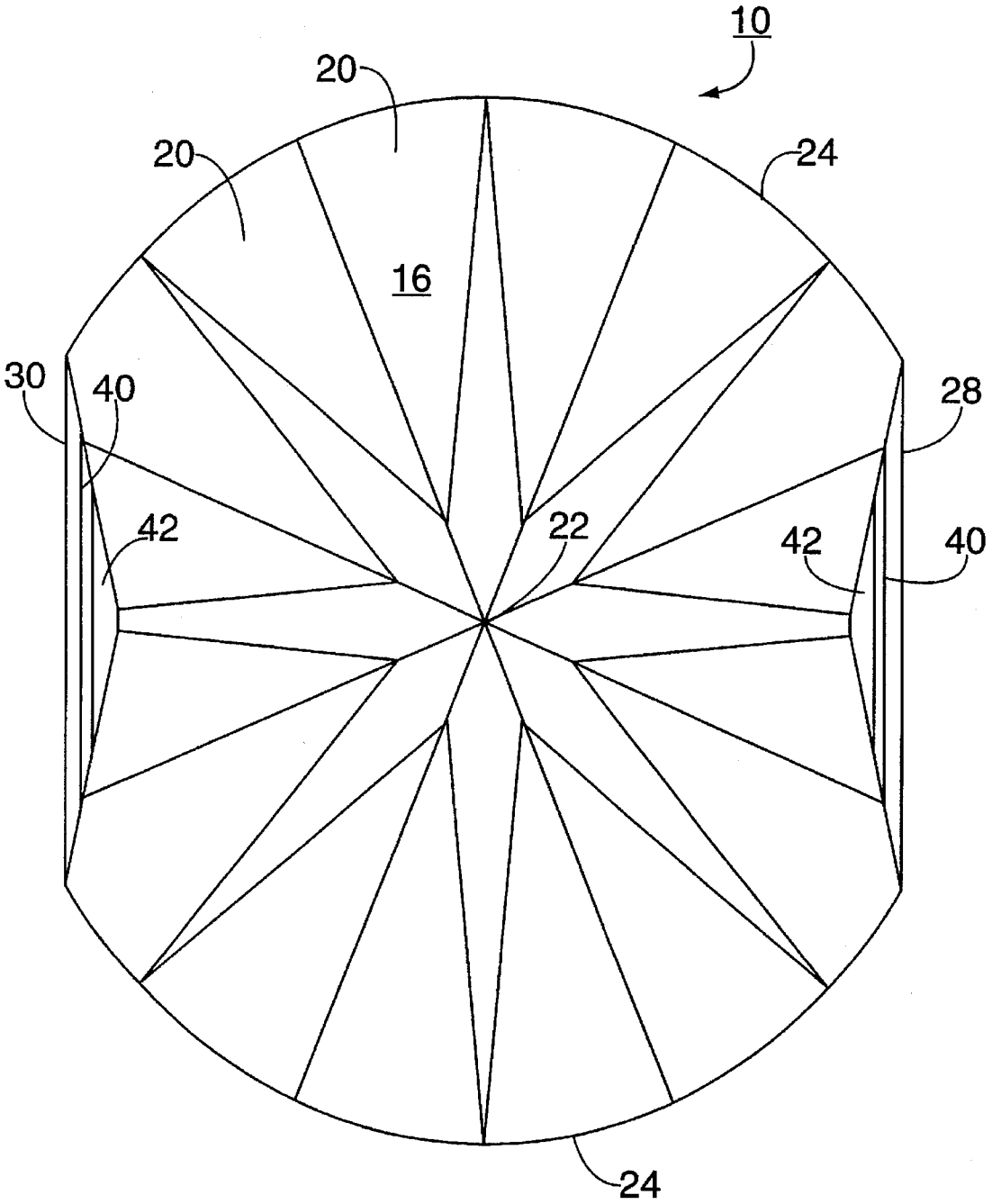
FIG. 3 is a bottom view of the diamond of the present invention.

FIG. 3 is a bottom view of the round diamond 10 primarily illustrating the pavilion 16 as having a plurality of facets 20 that radiate outward from the central region of pavilion 16 defined by the tip 22, previously described with reference to FIG. 1. Further, as discussed with reference to FIG. 1, the pavilion 16 has facets 42 each of which is located proximate the flattened portions 28 and 30 which may be further described with reference to FIG. 4.

Figure 4:
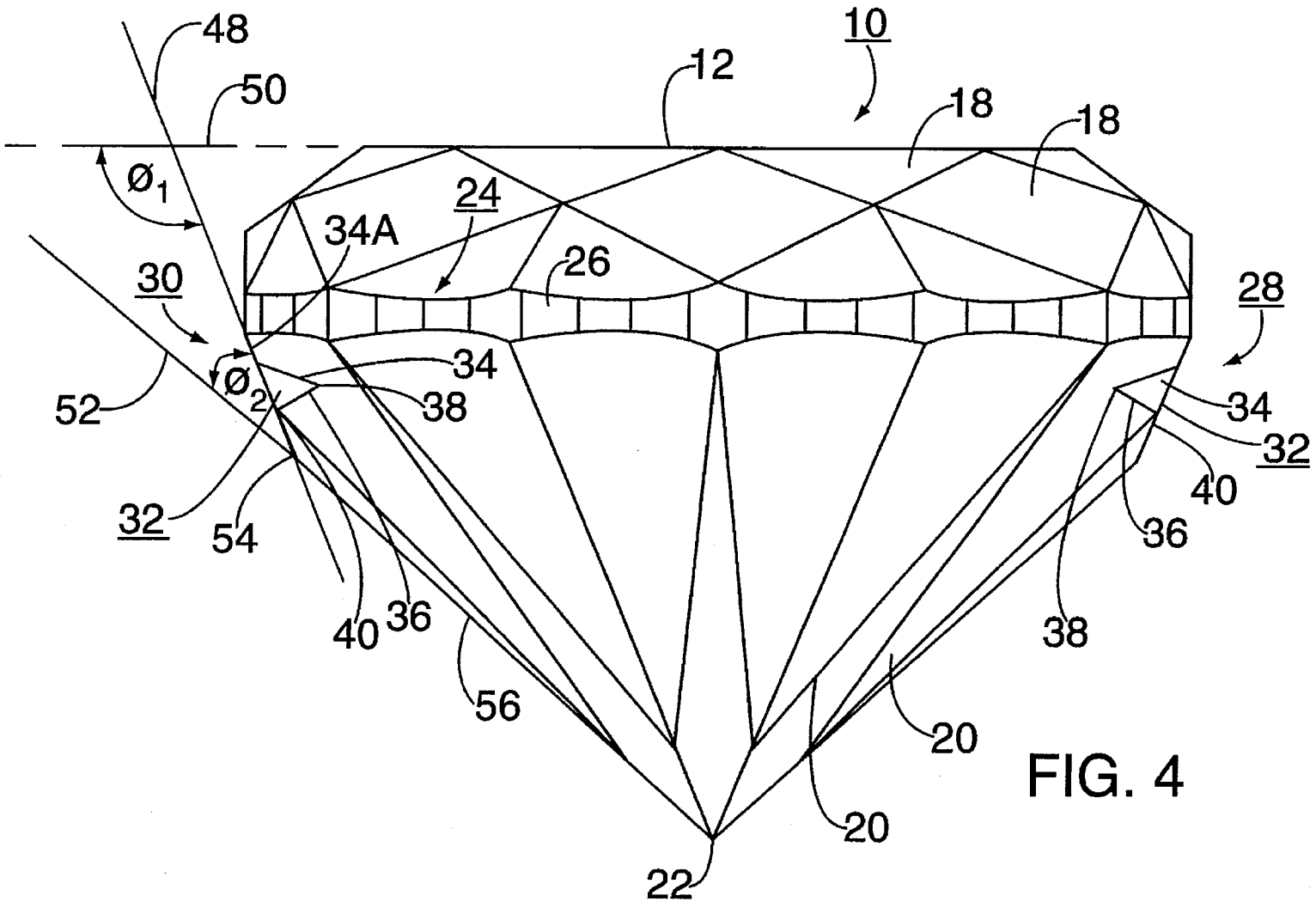
FIG. 4 is an end view of the diamond of the present invention.

FIG. 4 is an end view of the round diamond 10 and illustrates dimensional lines 48, 50 and 52 that define angles $\phi_1$ and $\phi_2$ that are applicable to both of the flattened portions 28 and 30. As seen with reference to flattened portion 30, also applicable to flattened portion 28, a point 54 defines the uppermost location of the outermost facet 20 as indicated by the dimensional line 56. The dimensional line 48 is drawn so as to be tangentially to point 54 and also in coincidence with boundary 40 previously described with reference to FIG. 1. The dimensional line 50 coincides with the surface of the table 12. The intersection of the dimensional lines 48 and 50 as shown in FIG. 4 defines the angle $\phi_1$.

As further seen with reference to flattened portion 30, a dimensional line 52 coincides with and extends from the dimensional line 56. The intersection of dimensional lines 48 and 52 as shown in FIG. 4 defines the angle $\phi_2$. From FIG. 4 it should be seen that angles $\phi_1$ and $\phi_2$ are both relative to the table 12, and that $\phi_1$ and $\phi_2$ are unequal. More particularly, the angle $\phi$, is preferably obtuse, whereas the angle $\phi_2$ is preferably acute. Further, from FIG. 4, it should be seen that cut-out 32 comprises two sloped walls 34 and 36, wherein (as previously mentioned) sloped wall 34 is directed inwardly and downwardly, whereas sloped wall 36 is directed inwardly and upwardly. The walls 34 and 36 merge and define a groove 38 which preferably extends the complete width of the cut-out 32. The sloped wall 34 of cut-out 32 has an entrance portion 34A which is upwardly sloped (as viewed in FIG. 4) so as to be in coincidence with dimension line 48 and share the defined angle $\phi_2$. The dimensions of the cut-out 32 of round diamond 10 are of particular importance to the present invention and are to be further described with reference to FIG. 6. The round diamond 10 forms part of an article of jewelry 58 of the present invention, which may be further described with reference to FIG. 5.

Figure 5:
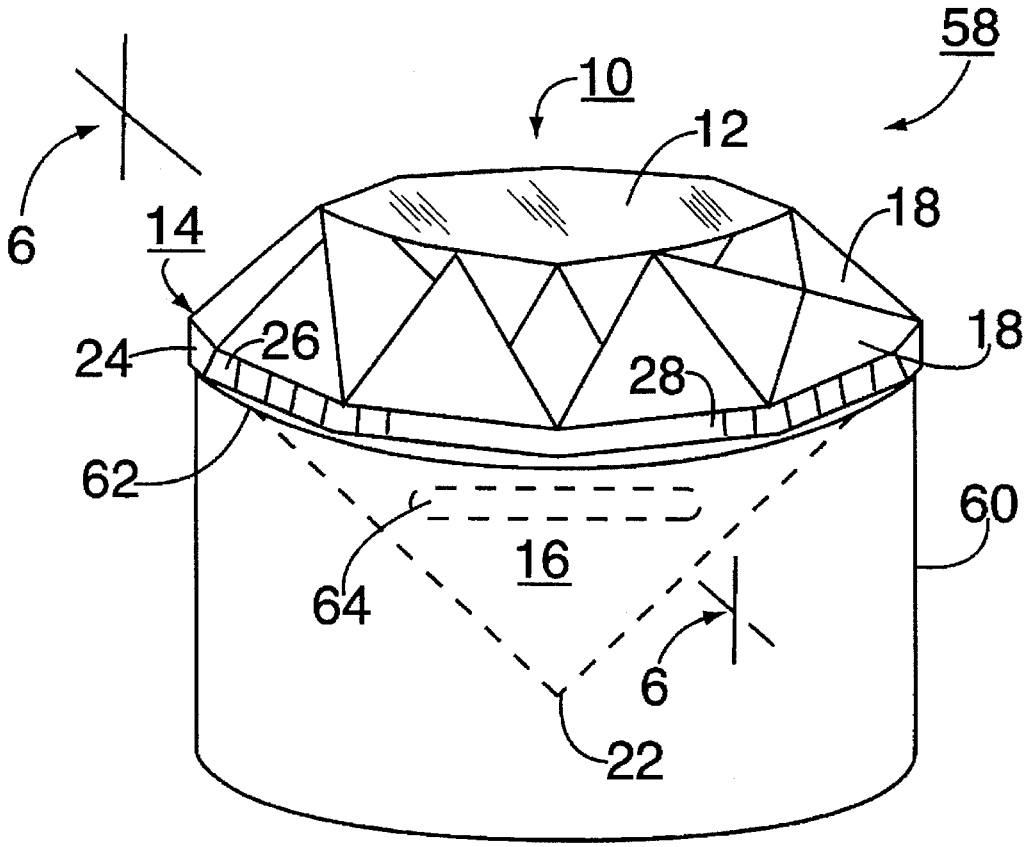
FIG. 5 is a perspective view illustrating the diamond being held in the barrel so as to form the article of the jewelry of the present invention.

FIG. 5 is a perspective view of the article of jewelry 58 which comprises the round diamond 10 and a barrel 60 having a rim 62. Although barrel 60 is relatively plain shaped, the practice of this invention contemplates that the barrel 60 may have decorative shapes, each having a somewhat different esthetic appeal. As seen in FIG. 5, the barrel 60, in particular the rim 62, is located under the girdle 14 of the round diamond 10 and in actuality the rim 62 is hidden by the girdle 14. The girdle 14 hides or makes invisible, to an observer, the rim 62 as well as reduces the prominence of the barrel 60. More particularly, the barrel 60 has an inner diameter which is shaped and selected to have corresponding values that are less than both the first predetermined distance 44 and the outer diameter 46 of the diamond 10, both illustrated in FIG. 2. Because the parameters of the round diamond 10 are larger than the shaped inner diameter of the barrel 60, the barrel 60 remains partially hidden from view by an observer. Furthermore, because the girdle 14 covers the rim 62, the rim 62 remains hidden from the view of an observer. Furthermore, the girdle 14 preferably includes the faceted belt 24 having the plurality of facets 26 which provide an esthetic appeal for the article of jewelry 58 and, thus, further distracts an observer from noticing either the barrel 60 or its rim 62. The barrel 60 further comprises a ridge means 64, located on the inner wall of the barrel 60 at oppositely disposed sides thereof so as to be in correspondence with the flattened portions 28 and 30. The parameters of the diamond 10 and the location and dimensions of the ridge means 64 are selected in a complementary manner so that the diamond 10 becomes set in the barrel 60 and is hidden from a viewer of the diamond 10. In addition, the practice of the present invention allows the round diamond 10 to be easily and rigidly set or attached to the barrel 60, which may be further described with reference to FIG. 6, which is a view taken along line 6—6 of FIG. 5.

Figure 6:
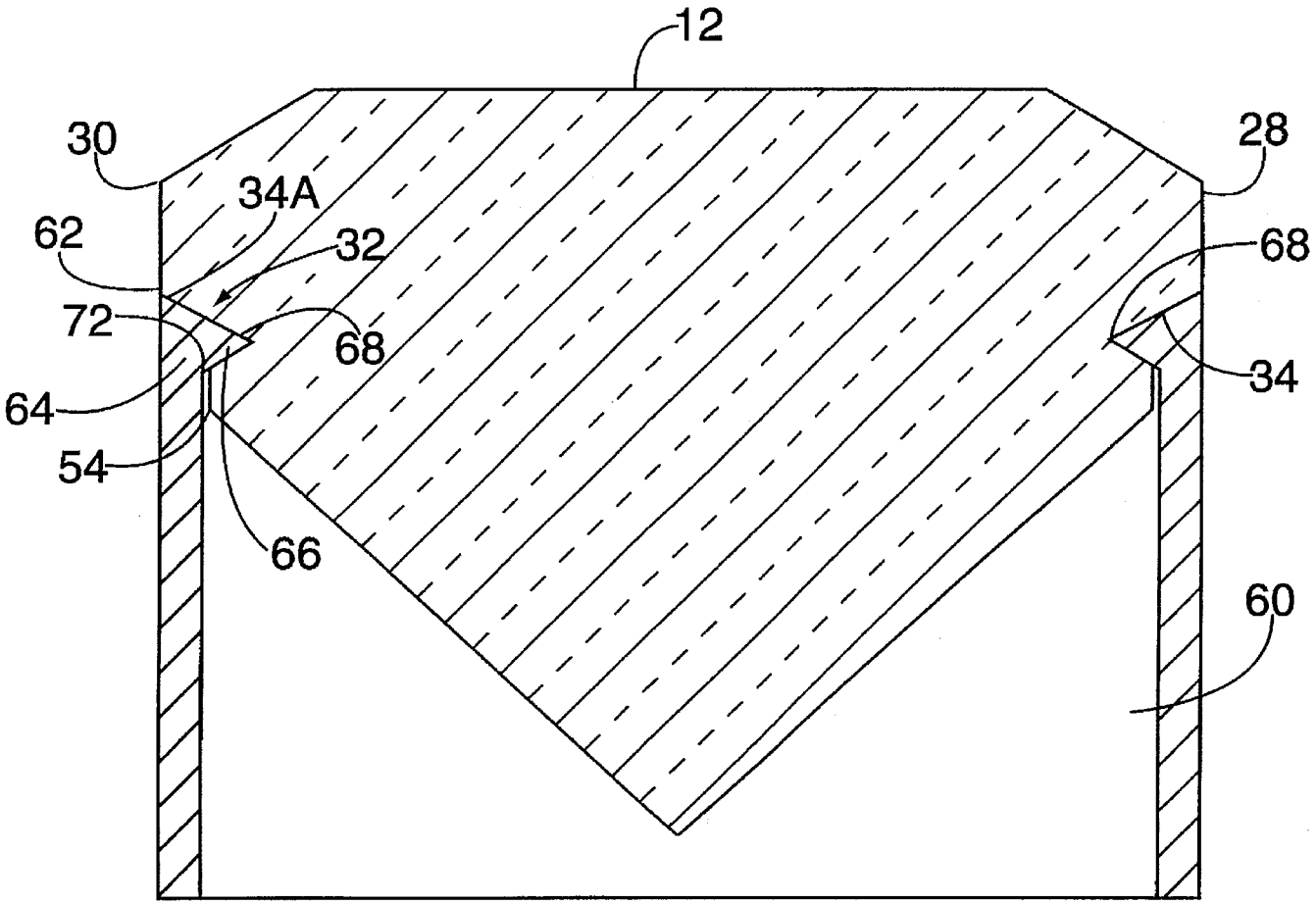
FIG. 6 is a sectional view taken along lines 6—6 of FIG. 5.

FIG. 6 is a cross-sectional view that illustrates, with respect to flattened portion 30 (also applicable to flattened portion 28), that the ridge means 64 has a prong 66 with a tip 68 and a lip which serves as the rim 62 shown in FIG. 5. The upward sloped portions 34A of flattened portions 28 and 30 each rests on the rim 62. The prong 66 is selected to have complementary dimensions as those of the cut-out 32 in both of the flattened portions 28 and 30. Further, the tip 68 is selected to have dimensions so as to frictionally engage at least a portion of the sloped wall 34.

More particularly, as seen in FIG. 6 with reference to the flattened region 28, the sloped wall 34 is shown in phantom, whereas the tip 68 is shown as engaging the sloped wall 34. As further seen in FIG. 6, the ridge means 64 not only frictionally engages the cut-out 32 by means of its tip 68, but also because of its other dimensions completely occupies the cut-out 32 and, thereby, allows the diamond 10 to be rigidly attached to the barrel 60, so as to eliminate any propensity of the diamond 10 from being accidentally dislodged from its barrel 60.

The material of the barrel 60 is selected to provide an elasticity characteristic so that the ridge means 64 not only tucks itself into the cut-out 32, but also deforms slightly so as to assist in maintaining frictional engagement between the tip 68 of the ridge means 64 and the sloped wall 34 of each of the flattened portions 28 and 30. A material that provides for such elasticity, while contributing to the luster of the article of jewelry 58, is gold. Further, the elasticity characteristic of the barrel 60 allows for the round diamond 10 to be pressed downward and onto the ridge means 64 so that the ridge means 64 finds its way into the cut-out 32 of each of the flattened portions 28 and 30 in a snap-lock manner. Furthermore, the location of ridge means 64 on the barrel 60 is selected so that the prisms 26 of the girdle 14 provide an effect that tends to visually hide the barrel 60 from being perceived by a viewer of the diamond 10.

It should now be appreciated that the practice of the present invention provides for the round diamond 10 to be easily and rigidly set in the holder 60. Furthermore, the round diamond 10 preferably has a faceted belt 24, which makes or substantially contributes to having the holder 60 less visible to the normal eye than that of the diamond 10. As worn, the round diamond 10, set in accordance with the practice of the present invention, prevents the luster of the diamond 10 from being retarded by the setting of the round diamond 10.

This invention has been described with reference to a preferred embodiment, and the scope and protection of this invention is as set forth in the appended claims.

What is claimed is:

1. An article of jewelry comprising:

(a) a round diamond having a table with a top surface, a girdle and a pavilion located below the girdle, said girdle having first and second oppositely disposed flattened portions spaced apart by a first predetermined distance, each flattened portion having a cut-out having a predetermined width and at least two sloped walls that run substantially parallel to said top surface of said table, said sloped walls being orientated so that one is directed in a first direction which is inward and downward into the diamond and the other of which is directed in a second direction opposite to said first direction so that said at least two sloped walls converge and merge to form a groove that extends across the width of said cut-out and runs substantially parallel to said top surface of said table, and (b) a barrel having a bore with a diameter which is less than said first predetermined distance of said girdle and having an inner wall with a ridge means for connecting said barrel to said round diamond with sides oppositely disposed from each other to correspond to said flattened portions and having a prong, said prong being dimensioned to snugly fit into said cut-outs of said flattened portions and to have a tip that engages one of said sloped walls of said cut-outs.

2. The article of jewelry according to claim 1, wherein one of said sloped walls of each of said cut-outs further comprises an entrance portion with an upwardly directed portion having a first defined angle relative to said top surface of said table and wherein said barrel has a rim dimensioned so that said entrance portions rest thereon.

3. The article of jewelry according to claim 1, wherein said girdle has facets around its perimeter, except at said flattened portions thereof.

4. The article of jewelry according to claim 1, wherein said barrel comprises a material having an elasticity characteristic so as to assist said ridge means to maintain its engagement with said sloped walls of said cut-outs.

5. The article of jewelry according to claim 4, wherein said material is gold.

* * * * *